United States Patent [19]

Heller et al.

[11] 4,334,571

[45] Jun. 15, 1982

[54] SCREEN AND SHELVING SYSTEM

[76] Inventors: Patricia S. Heller; Stephen M. Heller, both of 2300 Bridgeway, Sausalito, Calif. 94965

[21] Appl. No.: 151,067

[22] Filed: May 19, 1980

Related U.S. Application Data

[63] Continuation-in-part of Ser. No. 935,224, Aug. 21, 1978, abandoned.

[51] Int. Cl.[3] ..... A47G 5/00

[52] U.S. Cl. ..... 160/135; 52/36

[58] Field of Search ..... 160/135, 351; 52/36, 52/71, 239; 211/186, 189, 199

[56] References Cited

U.S. PATENT DOCUMENTS

| | | | |
|---|---|---|---|
| 1,514,038 | 11/1924 | Douglas | 52/239 X |
| 2,769,211 | 11/1956 | Hewitt | 52/36 X |
| 3,224,489 | 12/1965 | Haberthier | 160/135 |
| 3,788,378 | 1/1974 | Sobel | 160/135 |
| 3,871,435 | 3/1975 | Lopatka | 160/135 |
| 3,931,771 | 1/1976 | Kramer | 160/135 X |
| 4,001,987 | 1/1977 | Coulthard | 160/135 X |
| 4,047,342 | 9/1977 | Boulva | 160/351 X |
| 4,121,645 | 10/1978 | Behr | 160/135 |
| 4,232,724 | 11/1980 | Brown | 160/135 |

*Primary Examiner*—Philip C. Kannan

*Attorney, Agent, or Firm*—Townsend and Townsend

[57] ABSTRACT

A room dividing system in which a folding screen also serves to provide functional shelving is disclosed. A plurality of generally planar vertical panels are provided in two discrete widths. The panels have a plurality of vertically spaced holes in their vertical edge surfaces. Hinge plates, and shelf supports, can be attached to the panel using the holes in the vertical edge surfaces. Links interconnect respective hinge plates to join the panels together to provide a plurality of rectangular alcoves. Rectangular shelves fit in the alcoves and have underlying recesses engaged by the shelf supports. The shelves thus hold the panels together to provide structural rigidity and prevent collapse of the system.

4 Claims, 6 Drawing Figures

SCREEN AND SHELVING SYSTEM

This application is a continuation-in-part of our previous application of the same title, Ser. No. 935,224, filed Aug. 21, 1978, now abandoned.

DESCRIPTION OF THE PRIOR ART

The present invention relates to room dividers, and in particular to a room dividing system in which a screen not only divides a room into sections but provides functional shelving as well.

The concept of dividing a room into sections by a placement of lightweight, folding screens is ancient. Typically, a plurality of screen panels are hinged together at their ends, and are arranged in a zigzag fashion so that they do not topple over. As such, the screens have very little structural integrity, and serve no functional purpose other than dividing the room into sections.

Attempts to give the screens some semblance of structural rigidity, such as the incorporation of a "console" as set forth in the patent to Haberthier, U.S. Pat. No. 3,224,489, have been unsuccessful. In the Haberthier device, a console protrudes from one side of the screen, upsetting the balance of the screen, and loads placed on the console would appear to topple the screen.

Room dividers of a more permanent nature, such as those disclosed in the patents to Lopatka, U.S. Pat. Nos. 3,871,435, and to Sobel, 3,788,378, have often been used to support shelving. However, in such systems, the panels making up the system are relatively massive to provide a rigid wall structure. Such systems bear little resemblance to the free standing screens discussed above.

SUMMARY OF THE INVENTION

The present invention provides a room dividing system in which a folding screen also serves to provide functional shelving. A plurality of generally planar vertical panels are provided in two discrete widths. The panels have a plurality of vertically spaced holes in their vertical edge surfaces. A plurality of hinge plates are provided, each having a plate portion attachable to a vertical edge surface of one of the panels, and a screw fastener for fixing the plate portion to one of the holes therein. A vertical loop projects from the plate portion of each hinge plate. A plurality of connector links connect adjacent loop portions of respective hinge plates to hingeably interconnect the planar panels and their lateral edges. Each panel is pivotable about a vertical axis through at least 180° relative to each adjacent panel. The connected panels of respective widths form a series of rectangular alcoves.

A plurality of support elements are provided, each of which has a first portion overlying a vertical edge of a panel, and a screw fastener for fixing the first portion to a hole in the panel. Each support element projects outwardly from the face of the panel and includes an upwardly directed projection. A plurality of rectangular shelves are provided having dimensions generally equal to the inside dimensions of the alcoves. The shelves each include underlying recesses proximate their corners. The recesses of the shelves are engaged by the upwardly directed projections of the support elements. The shelves thus hold the panels together and provide structural rigidity to prevent collapse of the system.

The present invention provides a room dividing screen having the desirable aspects of folding screens known in the art, e.g., light weight, portability and easy storage. In addition, the present invention provides functional and usable shelving. The shelving is integrated into the system as discussed above so that the shelving becomes a structural element, and prevents collapse of the system. The system of the present invention is quite versatile, and the panels can be joined together in a modular fashion to provide a wide variety of useful combinations.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
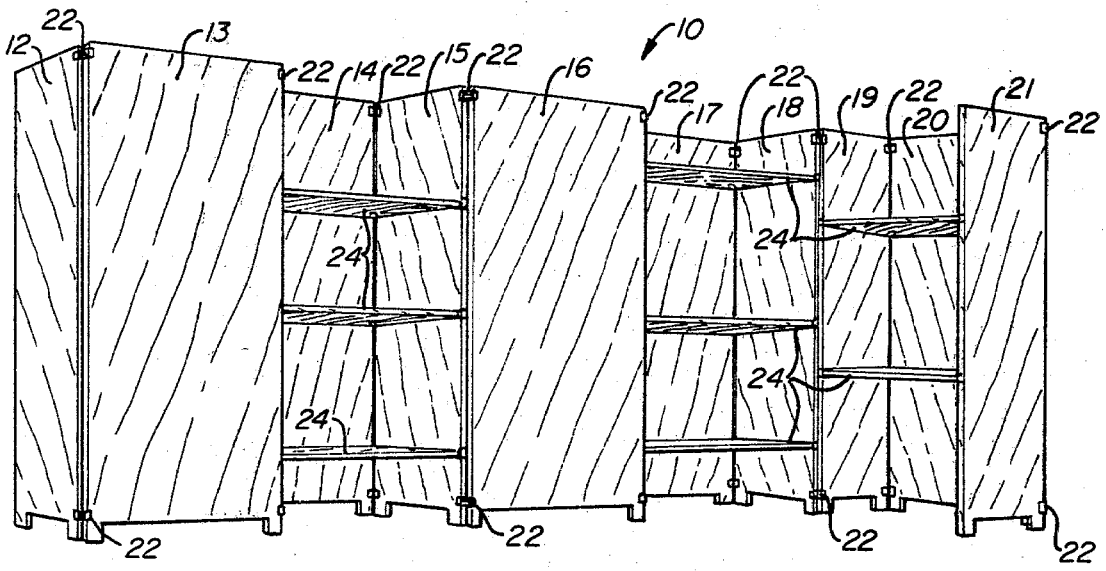
FIG. 1 is a perspective view of the system of the present invention.

As illustrated by reference to FIG. 1, the system 10 of the present invention includes a plurality of panel elements such as 12–21. Panels 12–21 are interconnected in series (certain intermediate panels are not visible in the drawing) by hinges 22. Panels 12–21 are all the same height, but come in two distinct widths. Specifically, panels 13, 14, 16, 17 and 20 have widths equal to one another, but much greater than the width of panels 12, 15, 18, 19 and 21. Each wide panel is separated from each other wide panel by at least one narrow panel.

By alternating narrow and wide panels in series, a plurality of equal size rectangular alcoves can be formed facing either in opposite directions or in the same direction. For example, wide panel 13, narrow panel 12, and another narrow panel invisible in the drawing form an alcove behind the screen as shown in FIG. 1. Wide panel 14, narrow panel 15 and the other narrow panel previously mentioned form a rectangular alcove facing forwardly in FIG. 1. Two narrow panels 18, 19 are located adjacent one another so that the entire screen system can turn 90° to form a side facing alcove formed by panels 19–21. Alternatively, three or four panels can meet at a single juncture to form other alcove configurations.

A plurality of shelves 24 are located in the alcoves formed by the respective panel members. Shelves 24 have a rectangular configuration, and the exterior dimensions of the shelves conform to the interior dimensions of the alcoves. Shelves 24 are integral structural elements of system 10 and are described in more detail hereinbelow.

Figure 2:
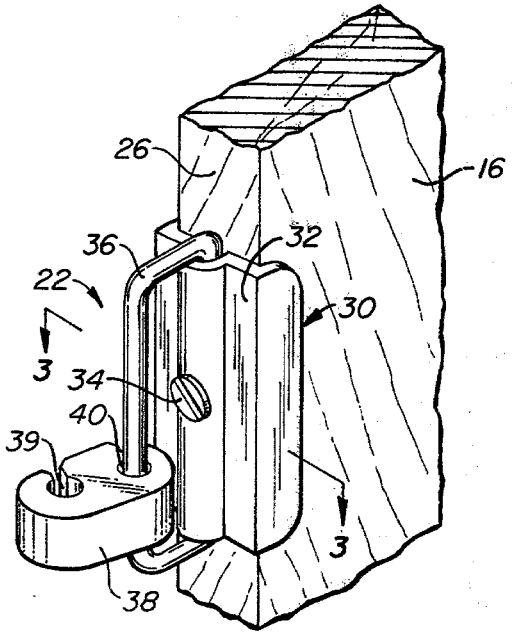
FIG. 2 is a fragmentary perspective view of one of the hinge elements of the present invention.
Figure 3:
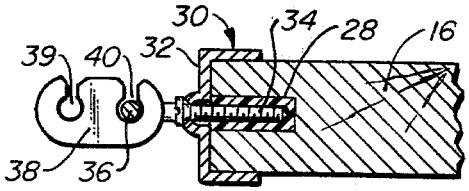
FIG. 3 is a section view taken along lines 3—3 of FIG. 2.

The basic elements of each hinge 22 are illustrated by way of reference to FIGS. 2 and 3 in combination, in which panel 16 is shown as an example. Each panel such as panel 16 has a vertical edge surface 26 having a plurality of vertically spaced, threaded holes 28 formed therein. Each hinge 22 includes a pair of plate elements such as 30 attaching to confronting edge surfaces such as surface 26. Plate element 30 includes a plate portion 32 adapted to overlie surface 26. Plate portion 32 is attached to panel 16 by a screw 34 engaging threaded hole 28. A vertically elongate loop 36 projects from plate portion 32.

Figure 5:
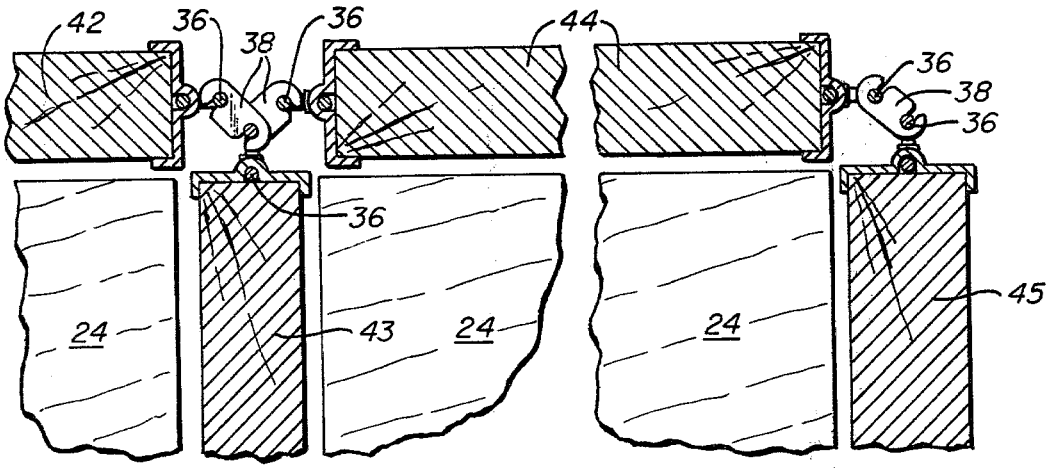
FIG. 5 is a fragmentary plan view illustrating the use of the hinges in constructing the complete apparatus of the present invention.

Connector links such as 38 having paired apertures 39, 40 are used to connect adjacent plate elements, as illustrated in more detail by way of reference to FIG. 5. FIG. 5 illustrates a sequence of panels 42–45. Three of the panels, 42–44, meet at one juncture, and two of the panels, 44 and 45, meet at another. Where the panels meet, a plurality of links 38 interconnect adjacent loop members 36. Connector links 38 allow the panels to rotate relative to one another generally up to at least 180°, except to the extent that adjacent panels might interfere.

Figure 4:
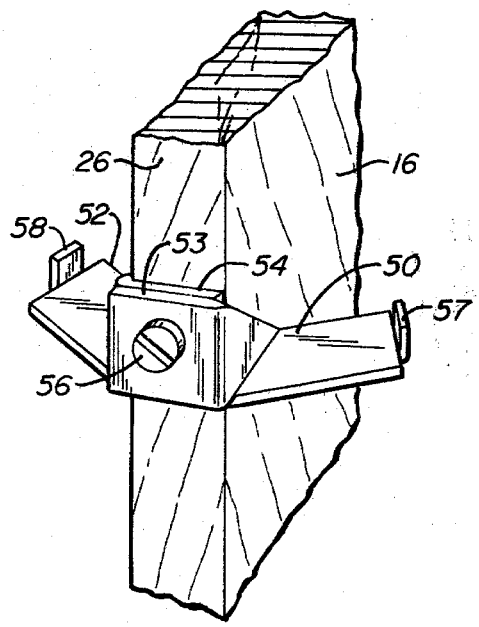
FIG. 4 is a fragmentary view of the installation of a pair of support elements of the present invention.

The elements used to support the shelves 24 of the present invention are illustrated by way of reference to FIG. 4. In FIG. 4, a different portion of panel 16 is illustrated from that shown in FIG. 2. A pair of support elements 50, 52 are mirror images of one another. Elements 50, 52 each include a planar portion 53, 54 respectively overlying vertical edge surface 26 of panel 16. A screw fastener 56 penetrates a hole 28 in the planar portions 53, 54 of the elements and engages one of the threaded apertures in panel 16 (see FIG. 3). Each element 50, 52 includes a second portion projecting outwardly from the side surfaces of panel 16, and terminating in upwardly directed projections 57, 58 respectively.

Figure 6:
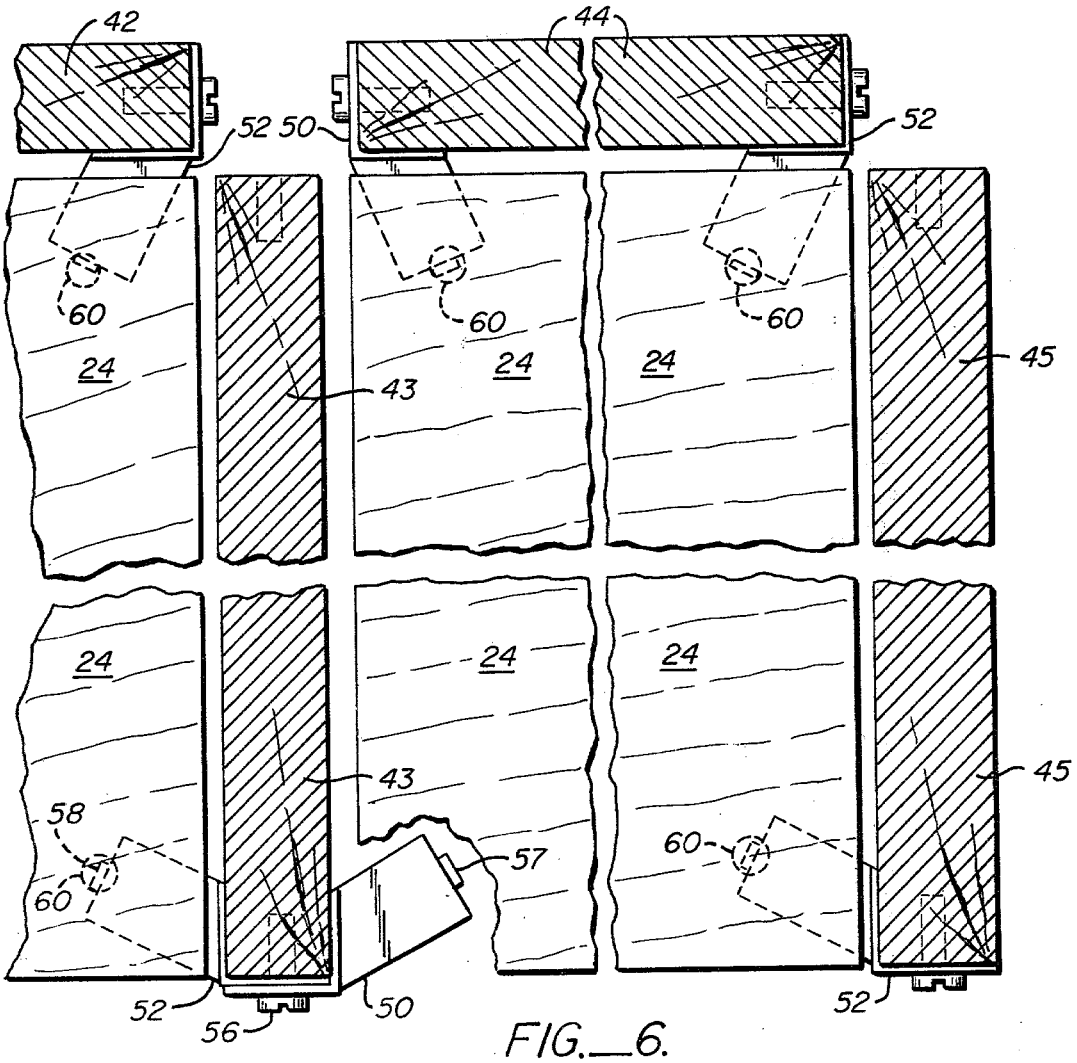
FIG. 6 is a fragmentary plan view illustrating the support of the shelves in the present invention.

The use of support members such as 50, 52, to support various shelves 24 is illustrated in more detail by way of reference to FIG. 6. Each shelf 24 has underlying recesses 60 near its respective corners. The upwardly directed projections 57, 58 of the respective support elements 50, 52 engage recesses 60. As a result, shelves 24 are interlocked with the surrounding panels, and the entire structure is rigidly interconnected.

The system 10 of the present invention retains the lightweight construction of prior art room dividing screens. However, the dimensions of the panels and their arrangement is such so that rectangular alcoves can be defined by the screens. Shelves are located within these alcoves, and are supported on each of the four corners so that the shelves are able to support substantial loads. Moreover, the shelves are interconnected with the panels in such a fashion that the entire system is quite rigid.

While a preferred embodiment of the present invention has been illustrated in detail, it is apparent that modifications and adaptations of that embodiment may occur to those skilled in the art. However, it is to be expressly understood that such modifications and adaptations are within the spirit and scope of the present invention, as set forth in the following claims.

What is claimed is:

1. A room dividing system comprising:

a plurality of generally planar vertical panels, certain of said panels having a width equal to a fixed dimension A and the remainder of said panels having a width equal to a fixed dimension B, B being less than A, said panels having a plurality of vertically spaced holes along their vertical edge surfaces;

a plurality of hinge plates each including a plate portion attached to a vertical edge surface of one of the panels, a screw fastener fixing the plate portion to one said hole, and a vertical loop projecting from the plate portion;

a plurality of connector links connecting adjacent loop portions of respective hinge plates to hingeably interconnect the planar panels at their lateral edges so that each panel is pivotable about a vertical axis through at least 180° relative to each adjacent panel, said connected panels forming a series of rectangular alcoves;

a plurality of support elements each having a first portion overlying an edge surface of one of the panels, a screw fastener fixing said first portion to one said hole, and a second portion projecting outwardly from the face of the panel and including an upwardly directed projection; and a plurality of rectangular shelves having dimensions generally equal to the inside dimensions of said alcoves for mounting therein, said shelves each including underlying recesses proximate their corners and engaged by the upwardly directed projections so that the shelves provide structural rigidity to the panels and prevent collapse of the system.

2. A system as recited in claim 1 in which the height dimension of each of the panels is substantially equal.

3. A system as recited in claim 1 wherein the connector links comprise a connector element having a pair of apertures opening in a common direction.

4. A system as recited in claim 1 wherein the vertical loop of each hinge plate is vertically elongate.

* * * * *